US010039971B2

(12) United States Patent
Schroeder et al.

(10) Patent No.: US 10,039,971 B2
(45) Date of Patent: Aug. 7, 2018

(54) DOWNHILL SNOW SPORT BOOT FRAME

(71) Applicant: ENVY SNOW SPORTS LLC, Golden, CO (US)

(72) Inventors: Christopher Michael Schroeder, Golden, CO (US); Michael Schroeder, Golden, CO (US)

(73) Assignee: ENVY SNOW SPORTS LLC, Golden, CO (US)

( * ) Notice: Subject to any disclaimer, the term of this patent is extended or adjusted under 35 U.S.C. 154(b) by 0 days.

(21) Appl. No.: 15/364,706

(22) Filed: Nov. 30, 2016

(65) Prior Publication Data

US 2017/0151488 A1 Jun. 1, 2017

Related U.S. Application Data

(60) Provisional application No. 62/261,686, filed on Dec. 1, 2015.

(51) Int. Cl.

| | |
|---|---|
| ***A63C 9/00*** | (2012.01) |
| ***A63C 10/14*** | (2012.01) |
| ***A43B 5/04*** | (2006.01) |
| ***A63C 9/22*** | (2012.01) |

(52) U.S. Cl.

CPC ..... *A63C 9/003* (2013.01); *A43B 5/0403* (2013.01); *A63C 9/002* (2013.01); *A63C 9/22* (2013.01)

(58) Field of Classification Search

CPC ..... A63C 9/002; A63C 9/003; A63C 9/005; A63C 9/22; A63C 10/10; A63C 10/106; A63C 10/14; A63C 10/145; A43B 5/0403

USPC ..... 280/636

See application file for complete search history.

(56) References Cited

U.S. PATENT DOCUMENTS

| | | | | | |
|---|---|---|---|---|---|
| 3,854,743 | A * | 12/1974 | Hansen | A43B 5/0415 | 280/618 |
| 4,002,354 | A * | 1/1977 | Ramer | A63C 9/005 | 280/614 |
| 4,367,885 | A * | 1/1983 | Ramer | A63C 9/00 | 280/614 |
| 5,142,798 | A * | 9/1992 | Kaufman | A43B 5/047 | 36/117.4 |
| 5,815,953 | A | 10/1998 | Kaufman et al. | | |
| 6,126,190 | A * | 10/2000 | Viodet | A63C 9/005 | 280/618 |
| 6,554,295 | B2 | 4/2003 | Rittmeyer | | |
| 6,863,285 | B2 * | 3/2005 | Gonthier | A43B 5/0403 | 280/14.22 |
| 2003/0094789 | A1 * | 5/2003 | Poscich | A63C 10/10 | 280/618 |

FOREIGN PATENT DOCUMENTS

WO WO 2009/097550 A1 8/2009

* cited by examiner

*Primary Examiner* — Frank B Vanaman

(74) *Attorney, Agent, or Firm* — Pauley Erickson & Kottis

(57) ABSTRACT

A ski boot frame that is attachable to a soft shell snow boot, for example a snowboard boot, for downhill skiing. The ski boot frame is constructed of multiple rigid materials to provide a user with proper support for downhill skiing. The ski boot frame further includes adjustable toe clip and heel clips for attachment to a standard downhill ski binding. The toe and heel clips are preferably adjustable to fit the frame to a plurality of sizes of ski bindings. The ski boot frame further includes a calf support that provides for a progressive forward resistance critical for downhill skiing.

19 Claims, 4 Drawing Sheets

DOWNHILL SNOW SPORT BOOT FRAME

CROSS REFERENCE TO RELATED APPLICATIONS

This application claims the benefit of, U.S. Provisional Patent Application Ser. No. 62/261,686, filed on 1 Dec. 2015. The Provisional Patent Application is hereby incorporated by reference herein in its entirety and is made a part hereof, including but not limited to those portions which specifically appear hereinafter.

FIELD OF THE INVENTION

This invention is directed to a snow sport boot frame for connecting a soft-shell snow boot to a conventional downhill ski or the like.

BACKGROUND OF THE INVENTION

A variety of devices are known for attaching a boot to skis, snowboards or the like. However, these known devices all suffer from limitations, such as limited compatibility with types and/or sizes of boots and skis, provide poor support to the user while engaging in snow sports, and/or lack proper safety devices.

U.S. Pat. No. 5,815,953, issued to Kaufman et al., discloses a downhill snow sport boot assembly that allows for a user to use any type of snow sport boot with skis or a snowboard. The Kaufman device is comprised of a solid, one piece base plate that is attached to a toe cap and molded metal components on each side of the base to provide lateral support. The Kaufman device further includes a one-piece calf support attached to the base on a pivoting mechanism. Forward resistance is provided by a spring like mechanism.

U.S. Pat. No. 3,854,743, issued to Hansen, discloses a ski boot attachment frame. The Hansen device includes a flat base plate with an attached toe and heel cup to allow for use with a boot. The Hansen device is designed to be used with an outdated type of bindings that do not comply with the DIN standard of modern ski boots.

International Patent Application No. WO2009097550, applicant Apex Sports, discloses a winter sports footwear device that includes an inner boot sized perfectly for an outer frame. The outer frame is comprised of a toe cap, a heel and an adjustable beam within a base plate. This design is not adaptable to be used with different types of boots and sizes.

As such, there is a need for a system for attaching a variety of boots to skis while providing proper and safe support to a user.

SUMMARY OF THE INVENTION

Modern ski boots are usually composed of a stiff plastic shell that surrounds a soft inner liner. The outer shell is relatively inflexible when fully buckled and is very difficult and uncomfortable to walk in for any more than a short distance. This stiffness is required for skiing but the boot must be worn to walk to and from the ski hill as well. In some versions, the soft inner liner may be removable however these removable liners do not include a proper sole and other components and cannot be used as a walking boot.

The invention of this application improves upon the design of the standard hard shell ski boot because the invention provides advantages of a stiff hard shell ski boot while allowing for the removal of a stiff outer frame to allow a user to easily walk in an inner snow boot. The snow boot may be any type of boot and preferably is a snowboard boot. The stiff outer frame provides all of the necessary forward and lateral support that is critical to skiing and allows the user to use their own snow boot, increasing user comfort on and off a ski hill.

In an embodiment of this invention, the ski boot frame includes a sole plate, a calf support pivotally connected to the sole plate. The ski boot frame further includes a toe clip and a heel clip mounted to the sole plate. The toe and heel clip are designed to engage with a standard ski binding to connect the ski boot frame to a ski. The ski boot frame also includes a plurality of boot connectors that provide a releasable connection for connecting the snow boot to the ski boot frame.

It is important the ski boot frame of this invention is capable of withstanding forces associated with downhill skiing. As such, the ski boot frame is preferably manufactured from strong and durable materials including, for example, aluminum, carbon fiber and/or thermoplastic.

In a preferred embodiment, the boot connectors comprise a plurality of adjustable straps that are secured to the frame located at the toe, ankle, shin and calf. The adjustability allows a user to adjust a tightness of the attachment of the ski boot frame to the snow boot. This adjustability allows for the ski boot frame to accommodate a variety of types and/or sizes of snow boots. This adjustability also plays a key role in user's perception of the transfer of movement from the user's foot to the direction the ski is going. This perception, known as "ski feel," is critical to the user because it allows them to make the quick side to side movements necessary for skiing.

Another important aspect of ski boot design is forward lean resistance. A progressive forward resistance is critical to proper ski technique because it allows the user to "load" the edge of the ski during a turn and then release that "load" while transitioning to the next turn. A boot that has no forward resistance would cause the user to lose control of the skis as they initiate the turn and a boot with no forward flexibility would make correct skiing technique uncomfortable and more difficult. The ski boot frame of this invention provides progressive forward resistance by attaching the calf support close to the ankle joint of the user, allowing the calf support to pivot forward in a natural motion. The calf support is also attached to the sole plate via a sole plate band that comprises curved metal extrusions acting as a three quarter elliptical spring that, when pushed forward, progressively increases forward lean resistance. In a preferred embodiment, the ski boot frame further includes a spring arm connected to the sole plate and providing resistance to rotation of the calf support at the connection of the calf support to the sole plate.

In a preferred embodiment, the ski boot frame is adjustable to accommodate a variety of ski bindings. Preferably, at least one of the toe clip and the heel clip is adjustable along the sole plate, relative to the other of the toe clip and the heel clip to accommodate a plurality of sizes of ski bindings.

DETAILED DESCRIPTION OF THE INVENTION

Figure 1A:
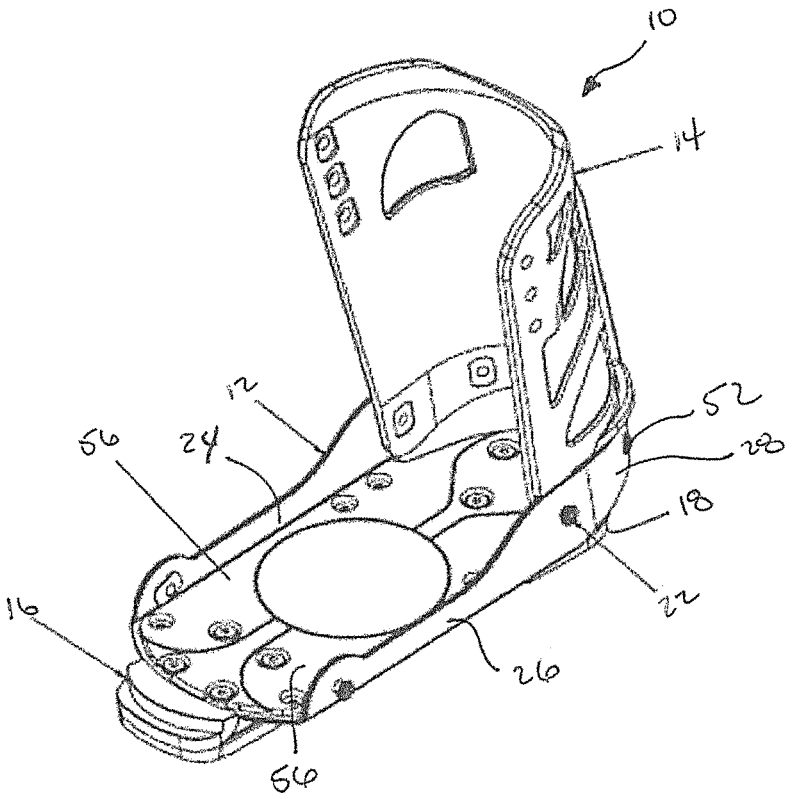
FIG. 1A is an isometric view of an embodiment of a boot frame for connecting a boot to ski bindings according to an embodiment of this invention.
Figure 1B:
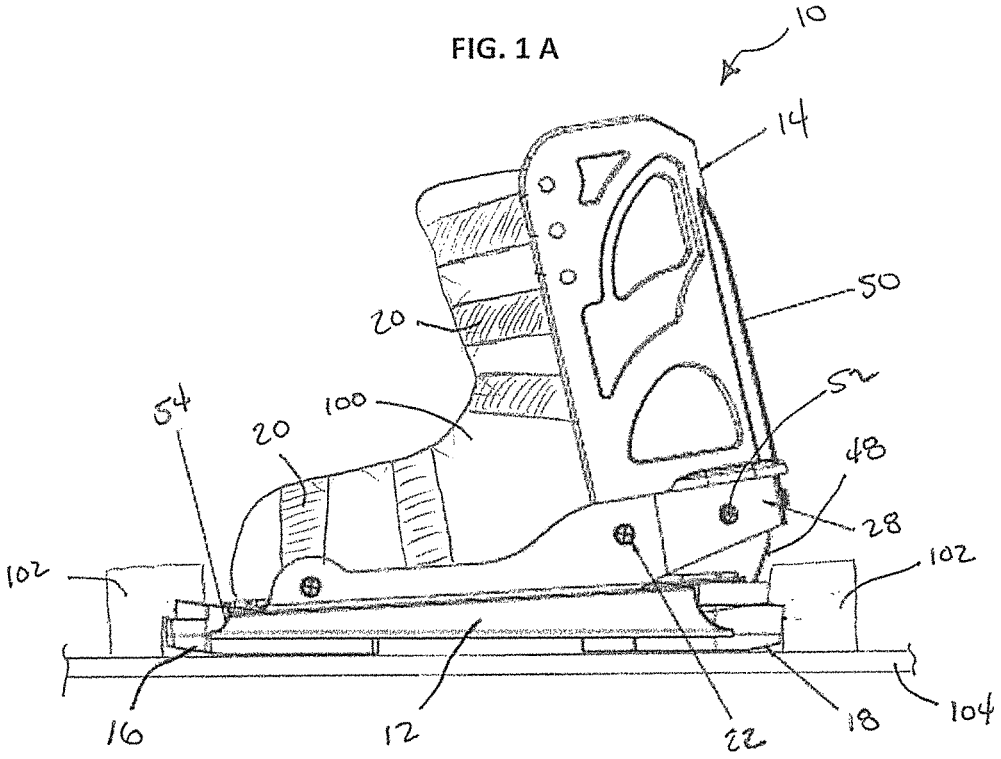
FIG. 1B is a side view of the boot frame of FIG. 1A with a representation of a ski boot and a portion of a ski.
Figure 1C:
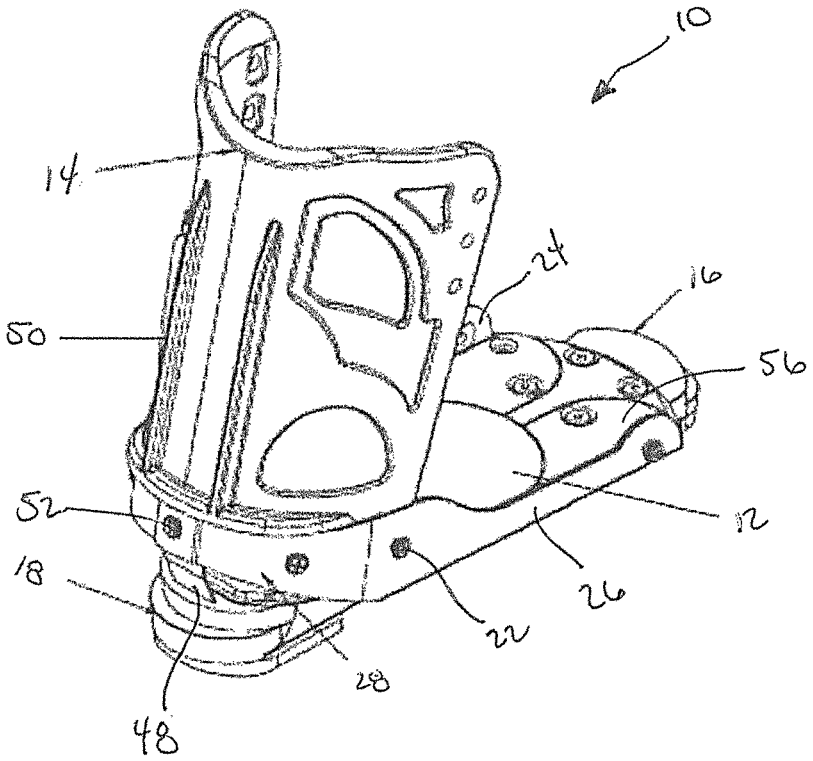
FIG. 1C is a rear isometric view of the boot frame of FIG. 1A.

A preferred embodiment of a ski boot frame 10 of this invention is shown in FIGS. 1A to 1D. The ski boot frame 10 of this invention is designed to be attached to a flexible snow boot 100 and connected to bindings 102 of skis 104. The ski boot frame 10 provides the necessary support to the flexible ski boot 100 for skiing. The ski boot frame 10 is also adaptable to be used with a variety of type and/or sizes of snow boots 100 and a range of sizes of ski bindings 102.

As shown in the figures, the ski boot frame 10 of this invention includes a sole plate 12, a calf support 14, a toe clip 16, a heel clip 18 and a plurality of connectors 20 for securing the boot 100 to the ski boot frame 10. The sole plate 12 is preferably connected to the calf support 14 with a pivot connection 22 that allows the calf support 14 to move relative to the sole plate 10. The toe clip 16 and the heel clip 18 are also connected to a bottom of the sole plate 12. At least one of the toe clip 16 and the heel clip 18 is connected to the sole plate 12 with an adjustable connection allowing for the clips 16, 18 to be adjusted to accommodate a range of conventional ski binding 102 sizes.

Figure 1D:
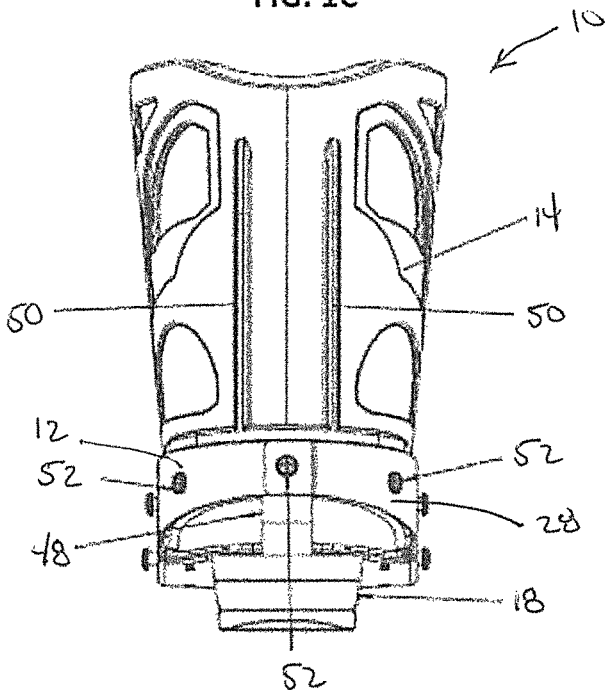
FIG. 1D is a rear view of the boot frame of FIG. 1A.
Figure 2A:
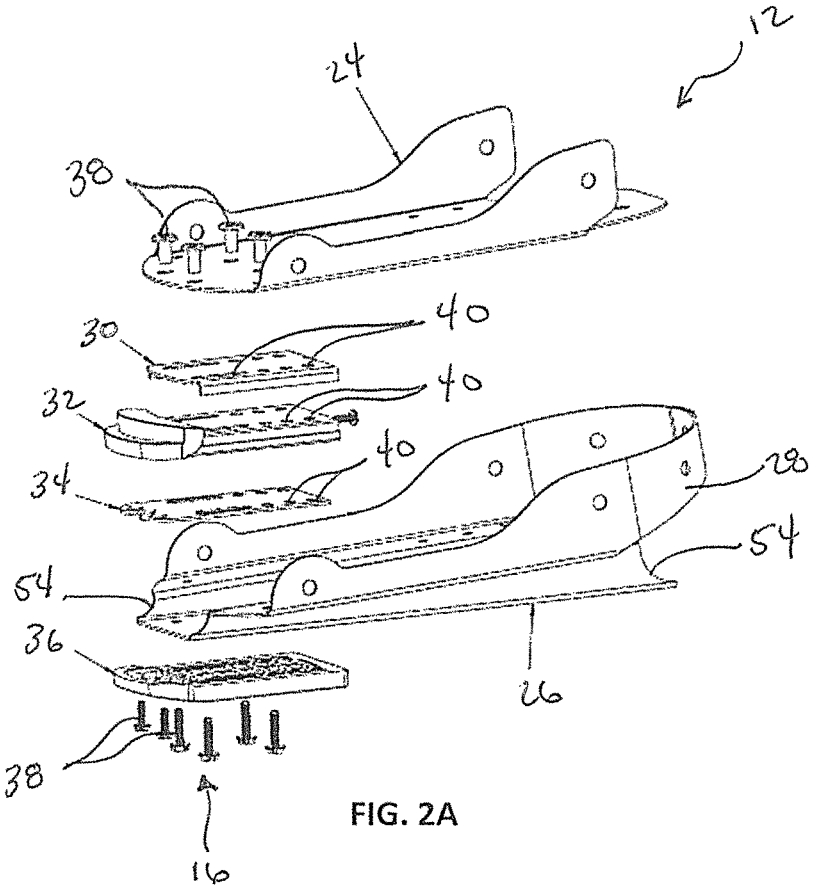
FIG. 2A is an exploded view of a toe assembly of the boot frame of FIG. 1A.
Figure 2B:
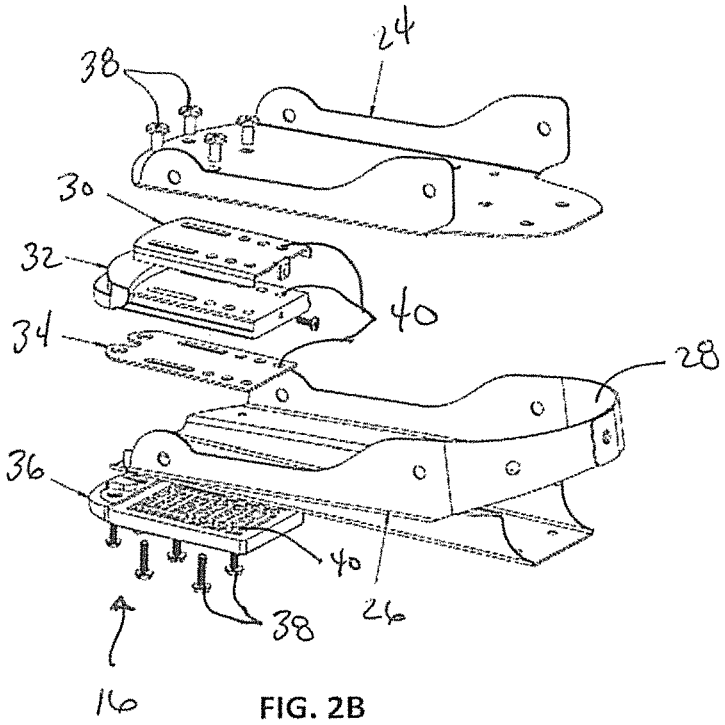
FIG. 2B is another exploded view of the toe assembly of the boot frame of FIG. 1A.

As shown in FIGS. 2A and 2B, the sole plate 12 preferably includes an upper sole plate 24 that partially mates with a lower sole plate 26. The sole plate 12 is preferably manufactured of a rigid material such as, but not limited to, aluminum and/or a composite material, such as carbon fiber and thermoplastic. These rigid materials allow the sole plate 12 to withstand the forces generated during skiing. In the embodiment of FIGS. 2A and 2B, the upper sole plate 24 comprises a flat surface with a pair of wings extending generally perpendicular from the flat surface on each side of the flat surface. The lower sole plate 26 comprises a tiered structure with a centered lower flat surface that rises to a pair of upper flat surfaces a pair of wings extending generally perpendicular to the pair of upper flat surfaces. As shown in the figures, the lower sole plate 26 may further include a band 28 that connects the pair of wings and, as shown in FIGS. 1A to 1D, around the calf support 14 to provide resistance to the movement of the calf support 14 relative to the sole plate 12. In the embodiment of FIGS. 2A and 2B, the upper sole plate 24 mates with the lower sole plate 26. The upper sole plate 24 sits on the pair of upper flat surfaces of the lower sole plate 26 between the wings of the lower sole plate 26. The upper sole plate 24 is connected to the lower sole plate 26 with a plurality of fasteners including, but not limited to, rivets, threaded connectors, adhesive and/or a weld connection. The tiered-shape of the sole plate 12 provides a rigid and durable structure that is capable of withstanding the forces applied during skiing while providing space to accommodate the toe clip 16, the heel clip 18 and other components of this invention. However, it should be understood that the sole plate is not limited to this design and may comprise alternative shapes and designs. For example, a recess in the lower sole plate 26 may not extend an entire length of the lower sole plate 26. Furthermore, the lower sole plate 26 and/or the upper sole plate 24 may include curved cut outs 54 in a front 16 and a rear 17 of the sole plate 12 that are recessed so that the sole plate 12 does not interfere with a toe or a heel of a standard ski binding. Preferably, the upper sole plate 24 includes a foam pad 56 that increases user comfort by reducing vibration and shock and helps the user's foot stay in position within the frame 10.

In a preferred embodiment of this invention, the sole plate 12 includes attachment points for the attachment of the toe clip 16 and the heel clip 18. The toe clip 16 and the heel clip 18 each include components that are shaped to fit into and to be releasably secured by the standard downhill ski binding 102.

In the embodiment shown in FIGS. 2A and 2B, the toe clip 16 comprises an adjustment plate 30, an upper toe clip 32, a reinforcement plate 34, and a lower toe clip 36. In a preferred embodiment, the upper toe clip 32 and the lower toe clip 36 are manufactured from thermoplastics and the adjustment plate 30 and the reinforcement plate 34 are made of metal, for example aluminum. However, it should be understood that the components may be manufactured of other materials. In a preferred embodiment, the adjustment plate 30 includes folded edges to provide additional support to the toe clip 16 when extended from the sole plate 12. In a preferred embodiment, the reinforcement plate 34 provides additional strength and support to the upper toe clip 32 and the lower toe clip 36, in case of a failure of the thermoplastic when the toe clip 16 is extended.

In the embodiment shown in the figures, the adjustment plate 30, the upper toe clip 32, and the reinforcement plate 34 are positioned between the upper sole plate 24 and the lower sole plate 26. The lower toe clip 36 is positioned below the lower sole plate 26. All the components of the toe clip 16 are attached to the sole plate 12 with a plurality of fasteners 38, in this case four bolts. In a preferred embodiment, each of the components of the toe clip 12 include a plurality of mounting holes and/or slots 40 to accommodate the fasteners 38. This arrangement allows the toe clip 16 to be mounted at a plurality of positions relative to the sole plate 12, allowing a user to extend or reduce an overall length between the toe clip 16 and the heel clip 18 in order to accommodate a range of different sized bindings 102. In the embodiment of FIGS. 2A and 2B, there are three different attachment points that the toe clip 16 can be mounted at, providing an inch of length adjustment.

Figure 3A:
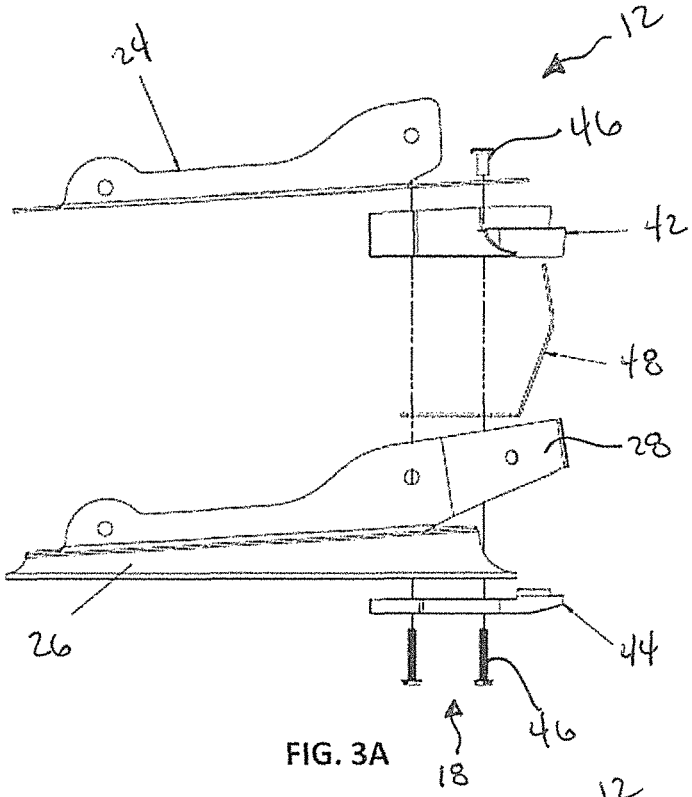
FIG. 3A is an exploded view of a heel assembly of the boot frame of FIG. 1A.
Figure 3B:
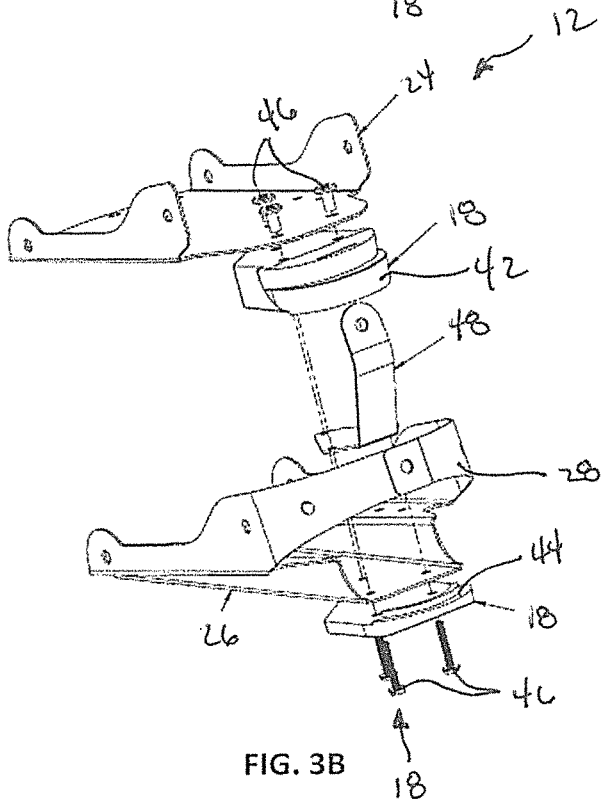
FIG. 3B is another exploded view of the toe assembly of the boot frame of FIG. 1A.

In the embodiment shown in FIGS. 3A and 3B, the heel clip 18 includes an upper heel clip 42 and a lower heel clip 44. In a preferred embodiment, the upper heel clip 42 and the lower heel clip 44 are manufactured from thermoplastics. Similar to the toe clip 16, the upper heel clip 42 is positioned between the upper sole plate 24 and the lower sole plate 26 and the lower heel clip 44 is positioned under the lower sole plate 26. The components of the heel clip 18 are attached to the sole plate 12 with a plurality of fasteners 46, in this case three bolts. The upper heel 42 and the lower heel 44 are designed to fit into a standard downhill ski binding. In a preferred embodiment, a calf support spring 48 is mounted to the sole plate 12 or the heel clip 18 and also attaches to the calf support 14 to provide forward lean resistance, as described below. The upper heel clip 42 may include a slot for the calf support spring to pass through, this slot supports the calf support spring 48 and helps retain the position of the upper heel 42.

As shown in FIGS. 1A to 1D, the calf support 14 attaches to the sole plate 12 and the lower sole plate band 28. The calf support 14 is preferably constructed of a thermoplastic or carbon composite material to provide the necessary strength and durability for downhill skiing. However, it should be understood that other materials may be used. As best shown in FIG. 1D, the calf support 14 preferably comprises a curved design that increases in diameter from a bottom of the calf support 14 to a top. This increased diameter is ergonomic and provides an improved fit and secure the user's boot to the ski boot frame 10. The calf support 14 preferably further includes a vertical rib 50 which provides structural support. In the embodiment shown, the calf support includes a pair of ribs however any number of ribs may be used.

In a preferred embodiment of this invention, the calf support 14 attaches to the upper sole plate 24 and the lower sole plate with a pivot connection 22 at ankle height which allows for a natural forward lean. The calf support 14 preferably also attaches to the lower sole plate band 28 with a fastener 52. In the embodiment shown, a pair of fasteners 52 are positioned near a rear area of the lower sole plate band 28 and a lower edge of the calf support 14. The curved nature of the lower sole plate band 28 provides a spring-like action to gradually increase a forward resistance on the user's leg as the user leans down the mountain or into a turn. In embodiment shown, the calf support spring 48 also attaches to both the lower sole plate 26 and the calf support 14. The calf support spring 48 is preferably made of aluminum, or another material with spring like properties, and is curved to allow for forward lean but eventually limits how far the calf support 14 can travel forward. The curved design of the calf support spring 48 provides gradual forward resistance needed for downhill skiing.

The ski boot frame of this invention allows a flexible snow boot 100 to be securely attached with a plurality of boot connectors 20. The boot 100 can be any of any type that is sufficient for winter but a preferred boot is a snowboarding boot. In this embodiment, the ski boot frame 10 includes four boot connectors however, any number of connectors may be used. The boot 100 and ski boot frame 10 may then be connected to a binding 102 of a ski 104. Thereby providing the necessary support to the flexible snow boot 100 for skiing. While, the detachablity of the frame 10 from the boot 100, allows a wearer to comfortably walk in the flexible boot 100 while not skiing. In a preferred embodiment, the boot connectors 20 may comprise a snowboard style ratchet strap, that includes a flexible ladder strap connected to one side of the ski boot frame 10 and a ratcheting clip connected to the other side of the ski boot frame 20. In an alternative embodiment of this invention, the boot connectors 20 may comprise a traditional ski boot latch, also known as an over-center levered latch, that includes a catch mounted on one side of the ski boot frame and a latch mounted on another side of the ski boot frame. Such boot connectors are preferred because the connector is adjustable to secure a range of different sized boots to the ski boot frame 10. However, other types of connectors may be used. In a preferred embodiment, the ski boot frame also includes a tension strap near the top of the calf support. The tension strap preferably includes a hook and loop fastener, also known as Velcro®.

The embodiments of the invention described herein are presently preferred. Various modifications and improvements can be made without departing from the spirit and scope of the invention. The scope of the invention is defined by the appended claims, and all changes that fall within the meaning and range of equivalents are intended to be embraced therein.

We claim:

1. A ski boot frame for connecting a boot to a ski binding, the ski boot frame comprising:

a sole plate including a sole plate band, wherein the sole plate comprises a lower sole plate and an upper sole plate, wherein the lower sole plate comprises a tiered structure and the upper sole plate mates the lower sole plate forming a recess in a center of the sole plate between the upper sole plate and the tiered structure of the lower sole plate;

a calf support connected to the sole plate at a pivot point and along the sole plate band, wherein the pivot point is adapted to align with an ankle joint of a user and the sole plate band resists movement of the calf support relative to the sole plate providing a forward lean resistance of the ski boot frame;

a plurality of boot connectors attached to the ski boot frame, wherein the boot connectors provide a releasable connection for connecting the boot to the ski boot frame;

a toe clip connected to the sole plate with a portion of the toe clip positioned within the recess, wherein the toe clip engages with the ski binding;

a heel clip connected to the sole plate with a portion of the heel clip positioned within the recess, wherein the heel clip engages with the ski binding; and wherein at least one of the toe clip and the heel clip is adjustable along the sole plate, relative to the other of the toe clip and the heel clip to accommodate a plurality of sizes of ski bindings.

2. The ski boot frame of claim 1, further comprising a calf support spring connecting the calf support to the sole plate and providing resistance to rotation of the calf support at the pivot point.

3. The ski boot frame of claim 1, wherein the sole plate band comprises a curved metal extrusion that operates as a three quarter elliptical spring.

4. The ski boot frame of claim 1, wherein the toe clip comprises an adjustment plate, an upper toe clip, a reinforcement plate, and a lower toe clip.

5. The ski boot frame of claim 1, wherein the calf support is curved.

6. The ski boot frame of claim 5, wherein a diameter of the curve increases from a bottom of the calf support to a top of the calf support.

7. The ski boot frame of claim 6, wherein the calf support includes a vertical rib to provide structural support.

8. A ski boot frame for connecting a boot to a ski binding, the ski boot frame comprising:

a sole plate comprising a lower sole plate, an upper sole plate and a lower sole plate band, wherein the lower sole plate comprises a tiered structure comprising a centered lower flat surface, a pair of risers extending from the centered lower flat surface and a pair of upper flat surfaces with wings and wherein the upper sole plate sits on the upper flat surfaces of the lower sole plate and forms a recess in a center of the sole plate between the upper sole plate and the lower sole plate;

a calf support connected to the upper sole plate and the lower sole plate at a pivot point and on the lower sole plate band, wherein the pivot point is adapted to align with an ankle joint of a user and the lower sole plate band resists movement of the calf support relative to the sole plate providing a forward lean resistance of the ski boot frame;

a plurality of boot connectors attached to the ski boot frame, wherein the boot connectors provide a releasable connection for connecting the boot to the ski boot frame:

a toe clip connected to the sole plate in the recess, wherein the toe clip engages with the ski binding;

a heel clip connected to the sole plate in the recess, wherein the heel clip engages with the ski binding; and wherein at least one of the toe clip and the heel clip is adjustable along the sole plate, relative to the other of the toe clip and the heel clip to accommodate a plurality of sizes of ski bindings.

9. The ski boot frame of claim 8, wherein the ski boot frame comprises at least one of aluminum, carbon fiber and thermoplastic.

10. The ski boot frame of claim 8, wherein the lower sole plate band comprises a curved metal extrusion that operates as a three quarter elliptical spring.

11. The ski boot frame of claim 8, further comprising a calf support spring connecting the calf support to the sole plate and providing resistance to rotation of the calf support at the pivot point.

12. The ski boot frame of claim 8, wherein the toe clip comprises an adjustment plate, an upper toe clip, a reinforcement plate, and a lower toe clip.

13. The ski boot frame of claim 8, wherein the calf support is curved.

14. The ski boot frame of claim 13, wherein a diameter of the curve increases from a bottom of the calf support to a top of the calf support.

15. The ski boot frame of claim 14, wherein the calf support includes a vertical rib to provide structural support.

16. A ski boot system comprising:

a ski including a ski binding;

a flexible snow boot:

a ski boot frame comprising:

a sole plate comprising a sole plate band, wherein the sole plate comprises a lower sole plate and an upper sole plate, wherein the lower sole plate comprises a tiered structure and the upper sole plate nests within the lower sole plate forming a recess in a center of the sole plate between the upper sole plate and the tiered structure of the lower sole plate;

a calf support connected to the sole plate with a rotatable connection and a calf support fastener, wherein a pivot point of the rotatable connection is adapted to align with an ankle joint of a user and the calf support fastener connects the calf support and the sole plate band to provide forward lean resistance;

a boot connector attached to at least one of the sole plate and the calf support, wherein the boot connector provides a releasable connection for connecting the flexible snow boot to the sole plate and the calf support;

a toe clip connected to the sole plate with a portion of the toe clip positioned within the recess, wherein the toe clip engages with the ski binding;

a heel clip connected to the sole plate with a portion of the heel clip positioned within the recess, wherein the heel clip engages with the ski binding; and wherein at least one of the toe clip and the heel clip is adjustable along the sole plate, relative to the other of the toe clip and the heel clip to accommodate a plurality of sizes of ski bindings.

17. The ski boot system of claim 16, further comprising a calf support spring connected to the sole plate and providing resistance to rotation of the calf support at the rotatable connection.

18. The ski boot frame of claim 16, wherein the sole plate band comprises a curved metal extrusion that operates as a three quarter elliptical spring.

19. The ski boot system of claim 16, wherein the toe clip comprises an adjustment plate, an upper toe clip, a reinforcement plate, and a lower toe clip.

* * * * *